US009194164B2

(12) United States Patent
Mukherjee et al.

(10) Patent No.: US 9,194,164 B2
(45) Date of Patent: Nov. 24, 2015

(54) HINGE JOINT SYSTEM

(75) Inventors: Sudipto Mukherjee, New Delhi (IN); Anoop Chawla, New Delhi (IN)

(73) Assignees: SIMPRI INVESTMENTS LIMITED, Hong Kong (HK); INDIA INSTITUTE OF TECHNOLOGY (IN)

( * ) Notice: Subject to any disclaimer, the term of this patent is extended or adjusted under 35 U.S.C. 154(b) by 301 days.

(21) Appl. No.: 12/780,840

(22) Filed: May 14, 2010

(65) Prior Publication Data

US 2011/0005036 A1 Jan. 13, 2011

(30) Foreign Application Priority Data

May 15, 2009 (IN) ..... 1001/DEL/2009

(51) Int. Cl.
*E05D 1/04* (2006.01)

(52) U.S. Cl.
CPC . *E05D 1/04* (2013.01); *Y10T 16/558* (2015.01)

(58) Field of Classification Search
CPC ..... E05D 1/04; E05D 2001/04
USPC ..... 16/267, 355, 260
See application file for complete search history.

(56) References Cited

U.S. PATENT DOCUMENTS

| | | | | | |
|---|---|---|---|---|---|
| 1,417,984 | A * | 5/1922 | French | 16/355 |
| 1,731,424 | A * | 10/1929 | Kohn | 403/119 |
| 1,772,560 | A * | 8/1930 | Soss | 16/250 |
| 1,987,774 | A * | 1/1935 | Hall | 16/355 |
| 2,034,810 | A * | 3/1936 | Hall | 16/355 |
| 2,680,534 | A * | 6/1954 | Penfold | 16/355 |
| 3,242,523 | A * | 3/1966 | Daley | 16/269 |
| 3,633,244 | A * | 1/1972 | Grossman | 16/355 |
| 3,648,328 | A * | 3/1972 | McCabe | 16/355 |
| 3,718,943 | A * | 3/1973 | Bustin | 16/355 |
| 8,863,360 | B2 * | 10/2014 | Mukherjee et al. | 16/353 |
| 2003/0200628 | A1 * | 10/2003 | Tatara | 16/355 |

FOREIGN PATENT DOCUMENTS

EP 2251511 A1 * 11/2010 ..... E05D 1/04

* cited by examiner

*Primary Examiner* — Emily Morgan
(74) *Attorney, Agent, or Firm* — Baker & McKenzie LLP

(57) ABSTRACT

The present invention relates to a hinge joint mechanism. The hinge joint mechanism comprises a fixed component including a plurality of curved portions and at least one straight portion; a movable component including a plurality of curved portions and a plurality of straight portions; said hinge joint mechanism provides a relative rotation between the two surfaces of the hinge joints to rotate the movable component by a desired amount relative to the fixed component. The hinge joint mechanism of the invention provides a proper sealing in the joints to avoid liquid or any such kind of material to move across it.

7 Claims, 3 Drawing Sheets

HINGE JOINT SYSTEM

TECHNICAL FIELD

The present disclosure relates to a hinge mechanism and more specifically to a hinged component.

BACKGROUND

Various types of Hinge Joints have been developed in the art. They provide a simple, efficient method of allowing two or more components to move about one another in a designated manner. Their simple construction and efficient performance, makes the hinge joints to be found in many everyday products, building structures, vehicles, and complex systems.

Perhaps the most common or well-known type of hinged joints comprises a movable member, such as a door or a lid, coupled to a stationary base or receiver capable of receiving the movable member and allowing the movable member to come to rest within the base or receiver. This fitting incorporates a hole to receive a pin therein which is affixed to a lock bar. The ends of the lock bar bend inwardly to press against the frame and the door for door locking purposes.

Moreover such pin based hinge joints fail to provide proper sealing in the joints to make them completely intact with each other.

Profiled hinged joints are also known in the art. Said joints have fixed member and movable member that is capable of partially rotating in the slot of the fixed member as disclosed in U.S. Pat. No. 4,315,345. The fixed member is having a hollow circular bead portion connected to the flange. This invention also does not restrict assembly/disassembly in non-axial directions.

The bead member is partially surrounded by a shell which protrudes from the flange. The gap between the shell and the bead member forms a slot in which the movable member rotates around the bead member. Said design does not provide any sealing properties as the slot in which the movable part rotates is not enclosed structure preventing leakage.

Moreover, other similar kinds of hinge joints fail to gain widespread acceptance either because of their relatively complicated nature, their appearance or inability to provide the necessary degree of desired protection.

SUMMARY

To obviate the aforesaid drawback, the present disclosure seeks to overcome these by providing a hinge joint mechanism with relatively better sealing across the joint and simpler construction because of a reduced number of components.

Therefore, it is an object of the present disclosure to provide a hinge mechanism with simple construction and said mechanism provides relative rotation between the two surfaces of the hinge joints such that movable part can rotate by a desired amount relative to fixed part.

To achieve said objectives the present disclosure provides a hinge joint mechanism comprising a fixed component includes a plurality of curved portions and at least one straight portion; a movable component includes a plurality of curved portion and a plurality of straight portions; wherein said hinge joint mechanism provides a relative rotation between the two surfaces of the hinge joints to rotate the movable component by a desired amount relative to the fix component.

BRIEF DESCRIPTION OF THE ACCOMPANYING DRAWINGS

The invention, together with its objects and advantages thereof may be best understood by reference to the following description taken in conjunction with the accompanying drawings, in which like reference numerals identify substantially like elements in the several figures and in which.

DETAILED DESCRIPTION OF THE INVENTION

Figure 1:
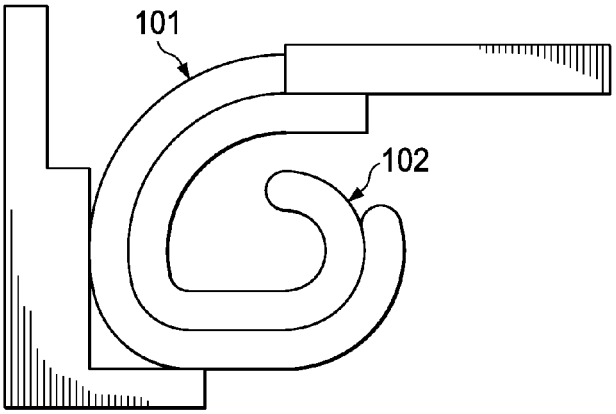
FIG. 1 shows hinge joint mechanism in its open position.

For the purpose of promoting an understanding of the principles of the invention, reference will now be made to the embodiment illustrated in the drawings and specific language will be used to describe the same. It will nevertheless be understood that no limitation of the scope of the disclosure is thereby intended, such alterations and further modifications in the illustrated bag, and such further applications of the principles of the disclosure as illustrated therein being contemplated as would normally occur to one skilled in the art to which the disclosure relates.

The hinge mechanism of the present disclosure provides a proper sealing in the joints to avoid liquid or any such kind of material to move across it.

FIG. 1 shows a hinge joint mechanism in its open position. The hinge mechanism contains two parts attached to (or integral to) two surfaces. A fixed part 101 and a movable part 102.

Figure 2:
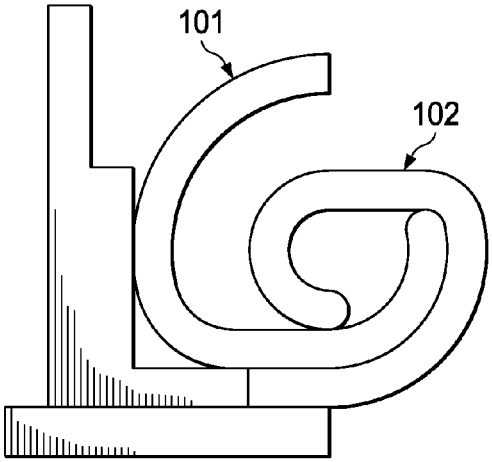
FIG. 2 shows hinge joint mechanism in its closed position.

FIG. 2 shows a hinge joint mechanism in its closed position. The hinge mechanism contains two parts attached to (or integral to) two surfaces. A fixed part 101 and a movable part 102.

Figure 3:
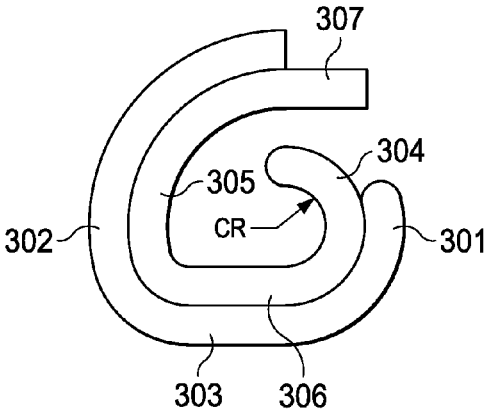
FIG. 3 shows hinge joint mechanism description in open position according to the present invention.

FIG. 3 shows hinge joint mechanism description in open position according to the present invention. The fixed part consists of two curved portions 301 and 302 and a straight portion 303. Similarly, the movable part also consists of two curved portions 304 and 305 and two straight portions 306 and 307.

Figure 4:
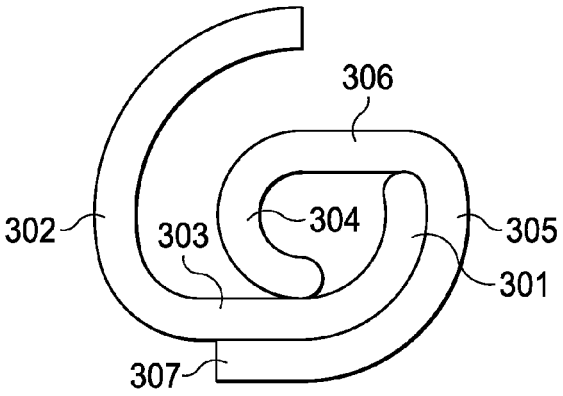
FIG. 4 shows hinge joint mechanism description in closed position according to the present invention.

FIG. 4 shows hinge joint mechanism description in closed position according to the present invention. The fixed part consists of two curved portions 301 and 302 and a straight portion 303. Similarly, the movable part also consists of two curved portions 304 and 305 and two straight portions 306 and 307.

Figure 5:
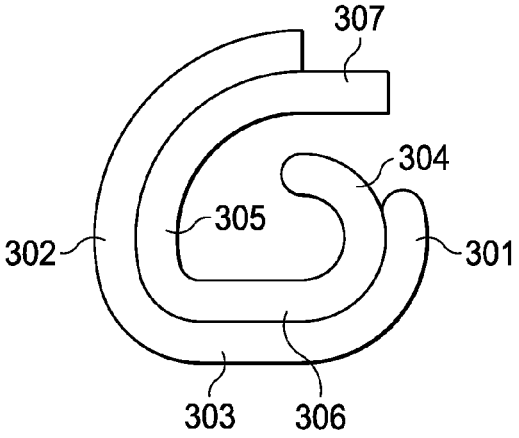
FIG. 5 shows the operation of hinge joint position at first stage.

FIG. 5 shows the operation of joint in the first stage. In the first stage of motion, the convex surface of the curved portion 304 of the movable part meshes with the concave surface of the curved surface 301 of the fixed part, convex surface of the curved portion 305 of the movable part meshes with concave surface of the curved portion 302 of the fixed part, and straight portion 306 of the convex zone of the movable part meshes with straight portion 303 of the concave zone of the fixed part.

Figure 6:
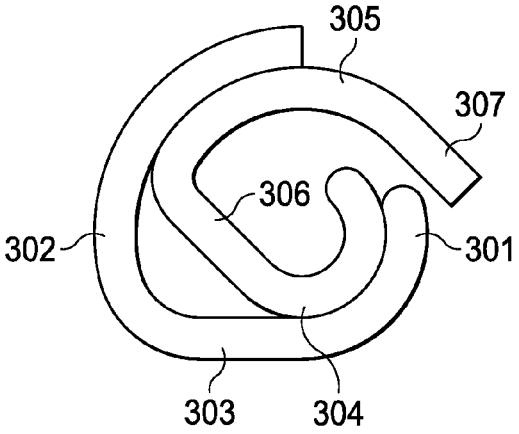
FIG. 6 shows the operation of hinge joint position at second stage.

FIG. 6 shows the operation of joint in the second stage. In the second stage of motion, the convex zone of the curved portion 304 of the movable part meshes with the concave zone of the curved portion 301 of the fixed part and convex zone of the curved portion 305 of the movable part meshes with the concave zone of the curved portion 302 of the fixed part.

Figure 7:
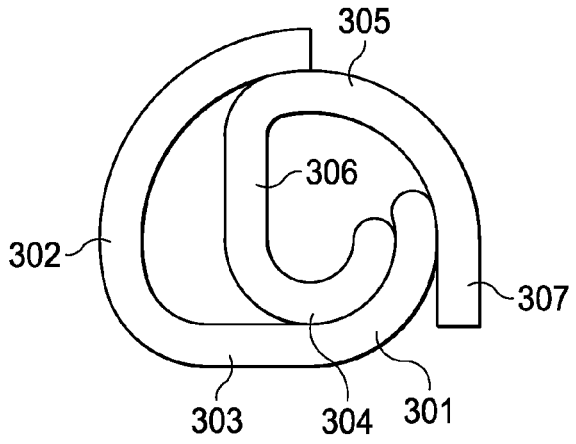
FIG. 7 shows the operation of hinge joint position at third stage.

FIG. 7 shows the operation of joint in the third stage. In the third stage of motion the convex zone of the curved portion 304 of the movable part meshes with the concave zone of the curved portion 301 of the fixed part and the convex zone of the curved portion 305 of the movable part meshes with the concave zone of the curved portion 302 of the fixed part.

Figure 8:
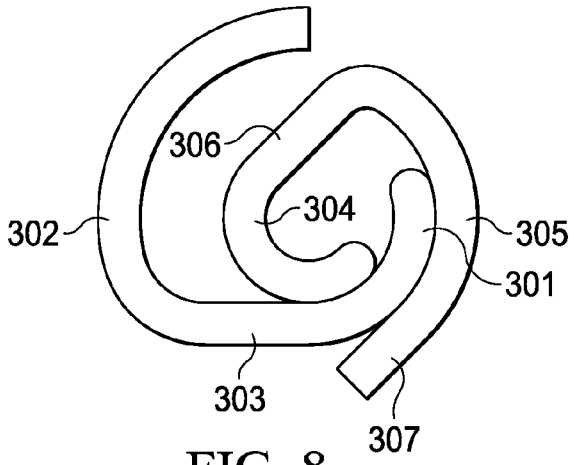
FIG. 8 shows the operation of hinge joint position at fourth stage.

FIG. 8 shows the operation of joint in the fourth stage. In the fourth stage of motion, the convex zone of the curved portion 301 of the fixed part meshes with the concave zone of the curved portion 305 of the movable part and convex zone of the curved portion 304 of movable part meshes with the concave zone of the curved portion 303 of the fixed part.

Figure 9:
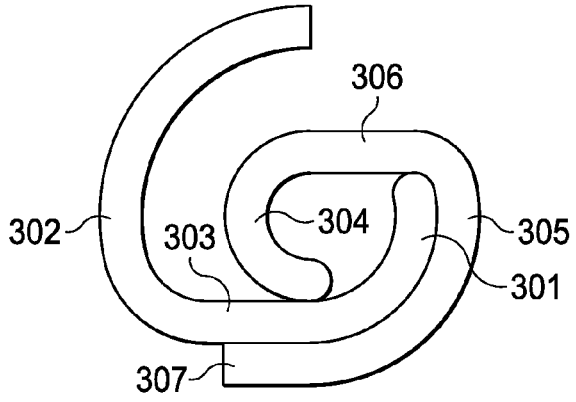
FIG. 9 shows the operation of hinge joint position at fifth stage.

FIG. 9 shows the operation of joint in the fifth stage. In the fifth stage of motion, the concave zone of the curved portion 305 of the movable part meshes with the convex zone of the curved portion 301 of the fixed part and the convex zone of the movable part (304) meshes with the concave zone of the fixed part (303).

Different zones of the fixed component and movable component mesh at a plurality of different angular positions during a hinge motion. The surfaces of the movable and fixed components comprise a plurality of contiguous zones of different curvatures with or without the same center of curvatures. The surfaces optionally include a surface of infinite curvature.

Further, the aforementioned sequence of motion stages results in a rotation between fixed part and movable part thereby causing a movement between the two surfaces 101 and 102 about the centre of rotation (CR) of hinge joint. This hinge joint also allows a predefined level of rotation. Beyond the predefined level of rotation (i.e. 180°), this rotation hinge point is self locked because in extreme position of the joint curved portion 301 of the fixed part and straight part 303 of the fixed part restrict further movement of curved portion 304 of the movable part and straight part 306 of the movable part respectively.

In the other extreme position of the joint curved portion 302 of the fixed part and straight part 303 of fixed part restrict further movement of straight part 306 and 307 of movable part respectively.

Further, movable part and fixed part can be assembled or disassembled only in axial direction of hinge. The hinge can be optionally be used along with a lock in the locked and unlocked positions.

The hinge mechanism of the present disclosure is used in various appliances/equipment. Said hinge mechanism is used in a container and more particularly in a transport container.

All documents cited in the description are incorporated herein by reference. The present disclosure is not to be limited in scope by the specific embodiments and examples which are intended as illustrations of a number of aspects of the disclosure and any embodiments which are functionally equivalent are within the scope of this invention. Those skilled in the art will know, or be able to ascertain using no more than routine experimentation, many equivalents to the specific embodiments of the described herein.

We claim:

1. A hinge joint mechanism comprising:

a first component comprising a plurality of curved portions and at least one straight portion disposed between at least two curved portions, wherein one of the at least two curved portions is a terminus of the first component;

a second component comprising a plurality of curved portions and one straight portion disposed between at least two curved portions, wherein one of the at least two curved portions is a terminus of the second component;

wherein said hinge joint mechanism provides a relative rotation between the second component and the first component;

wherein during the rotation, the first and second components maintain contact against each other at at least one of the straight or curved portions of both the first and second components, wherein in an open position, the second component is substantially enveloped by the first component;

wherein the terminus of the second component has a greater length than the terminus of the first component;

wherein the terminus of the second component comprises an arc forming substantially a semicircle, and the terminus of the first component comprises an arc forming less than a semicircle;

wherein the terminus of the second component maintains contact with the first component during the rotation;

wherein the terminus of the first component comes into contact with both an inner surface and an outer surface of the second component during rotation; and wherein the first component and the second component are configured to be assembled or disassembled only in a substantially axial direction of the hinge joint.

2. The hinge joint mechanism as claimed in claim 1, wherein the second component rotates with respect to the first component as long as at least one of the curved portions of the second component interacts with at least one of the curved portions of the first component thereby interlocking the second component and the first component.

3. The hinge joint mechanism as claimed in claim 1, wherein the plurality of curved portions of the second component are designed to contour against the plurality of curved portions of the first component.

4. The hinge joint mechanism as claimed in claim 1, wherein the at least one straight portion of the second component is designed to contour against the at least one straight portion of the first component.

5. The hinge joint mechanism as claimed in claim 1, wherein different zones of the first component and second component interact at a plurality of different angular positions during a hinge motion.

6. The hinge joint mechanism as claimed in claim 1, wherein the rotation of the second component about the first component is constrained by the first component.

7. The hinge joint mechanism as claimed in claim 1, wherein the hinge joint mechanism is part of a transport container.

* * * * *

UNITED STATES PATENT AND TRADEMARK OFFICE

CERTIFICATE OF CORRECTION

PATENT NO. : 9,194,164 B2
APPLICATION NO. : 12/780840
DATED : November 24, 2015
INVENTOR(S) : Sudipto Mukherjee and Anoop Chawla It is certified that error appears in the above-identified patent and that said Letters Patent is hereby corrected as shown below:

On Title Page, Item (73), Assignees:

Delete "INDIA" in the Assignee named "INDIA INSTITUTE OF TECHNOLOGY" and insert --INDIAN-- so it reads --INDIAN INSTITUTE OF TECHNOLOGY--.

Signed and Sealed this
Second Day of August, 2016

Michelle K. Lee

Michelle K. Lee
*Director of the United States Patent and Trademark Office*